United States Patent [19]

Bressan et al.

[11] Patent Number: 4,563,887

[45] Date of Patent: Jan. 14, 1986

[54] CONTROLLED SPIN FLOW FORMING

[75] Inventors: Renato J. Bressan; Andrew Halasz, both of Crystal Lake, Ill.; Lawrence S. Maccherone, Severna Park, Md.

[73] Assignee: American Can Company, Greenwich, Conn.

[21] Appl. No.: 542,309

[22] Filed: Oct. 14, 1983

[51] Int. Cl.[4] ..... B21D 17/04

[52] U.S. Cl. ..... 72/84; 72/105

[58] Field of Search ..... 72/84, 105, 106, 110

[56] References Cited

U.S. PATENT DOCUMENTS

B 223,678 3/1976 Nixon et al. .

2,312,225 2/1943 Wilkinson ..... 72/106

4,070,888 1/1978 Gombas ..... 72/105

4,144,732 3/1979 Franks et al. ..... 72/84

*Primary Examiner*—Lowell A. Larson

*Attorney, Agent, or Firm*—Paul R. Audet; James B. Kinzer

[57] ABSTRACT

A system and apparatus for roll forming to neck-in D&I cans ends and replace double necks and triple necks is disclosed. An externally disposed free roll is moved inward and axially against the outside wall of the open end of a trimmed can. A spring loaded interior support roller moves under the forming force of the free roll. This is a single operation where the can rotates and the free roll rotates such that a smooth conical necked end and flange are produced.

4 Claims, 1 Drawing Figure

CONTROLLED SPIN FLOW FORMING

BACKGROUND OF THE INVENTION

This invention relates to containers; the body for such containers being in the form of cylindrical one-piece metal can having an open end terminating in an outwardly directed peripheral flange merging with a circumferentially-extending neck portion (the can body being hereinafter referred to as a D&I can). Methods of forming said neck and flange in a D&I can body and to apparatus for forming the said peripheral flange and neck portion.

The background for this disclosure relates to the way in which D&I can bodies are manufactured in drawing and then multiple ironing operations. For 20 years beverage containers have been made by a drawing and then multiple ironing processes in which the metal material is first drawn into a cup to establish the shape and a basic inside diameter and the cup is then pushed through a series of ironing rings which merely thin the side wall and do not appreciably affect the diameter.

The cross-sectional configuration of the ironing ring includes a chamfer, a land and finally a relief angle. The ironing process begins on the chamfer and is completed by the land during which time no drawing takes place. The process is done at high speed under a coolant/lubricant flood in order to accommodate the severity of the operation especially the heat. These containers have to be washed and in some cases chemically treated to remove residual lubricant and improve corrosion performance of organic coatings and decoration subsequently applied to the container. Coatings are normally applied after the shell has been trimmed and washed free of lubricants and metal fines.

The ironing steps result from the difference between the clearance between a punch and ironing ring land and the thickness of the metal sidewall. That clearance represents the amount to which the side wall of the container will be thinned. Usually, metal with no organic coating passes through three different ironing rings in a D&I operation during which ETP electrolytic of T-1 to T-5 temper tinplate or H19 aluminum container sidewall is reduced about 25% in the first pass, about 25% of its new thickness in the second pass, and about 40% of its new thickness in the last pass, while the metal and tooling are flooded with lubricant coolant.

This operation increases the side wall length to several times that of the cup which was formed in an ordinary and separate one or two-draw operation. The cleaned and trimmed D&I can may then be necked and flanged in a separate apparatus and an independent operation. The grain orientation of the ironed sidewall is highly directional and the D&I can is subject to longitudinal cracking particularly at the radially extending flange. The purpose of the peripheral flange is usually to provide an element to which a can end is secured after the can has been filled, this securing being done by deforming the end flange of the can body together with a peripheral cover hook of the can end so as to form a double seam. Consequently, flange cracks are a problem to achieving a hermetic double seam. The neck enables the flange, and therefore the can end, to be of smaller diameter than if there were no neck; usually the radial depth of the neck is such that the double seam has an external diameter less than that of the cylindrical side wall. Necking also minimizes the radial extent of the flange thus helping to resist flange cracking.

In some types of metal lids, such as those having easily opened ends of the so-called "ring pull" or "tab" type, the end to be seamed on to the flange of the can body is preformed with the scored opening feature. These opening features often determine the diameter of the end and only recently has the tab-type been reduced in size to permit ends as small as 202 being 2 and 2/16" across the double seam (can makers conventional terminology).

The end neck may serve another purpose, which is to provide a convenient means whereby a carrier can engage the container; such carriers are designed to hold a plurality of containers and may be of, for example, paperboard or a flexible plastic material. The type of carrier which engages the neck of a container of the kind with which this disclosure is concerned may include a horizontal web in which there are a plurality of holes, the periphery of each hole engaging below the above-mentioned container double end seam so as to support the container wholly or partly thereby. Where the container body is necked, the neck can be so shaped as to provide some measure of support and/or restraint for the carrier web around the hole in the latter, and to assist in locking the container to the web until the user wishes to pull it away from the carrier. Similarly, a reduced neck allows the cans to be held in close parallel relation thus, minimizing the total space needed to hold the containers. In addition, the necked end can can be designed to stack against the bottom of a similar container for ease of shipping.

Various methods have been used and proposed for forming an end neck and flange on a one-piece can body. Some methods involve molding the neck and/or the flange by means of circumferentially extending molds. Die necking has also been used to longitudinally move a die against the end of a supported D&I can to force same to a smaller diameter by means of the application of the die. Other methods involve rolling or spinning the neck and/or flange, using an external spinning roll of a given shape co-operating with an internal member of a companion shape within the can body. In these latter methods, the can body is supported rigidly by an internal mandrel or the like; the internal member may be a spinning roll, pilot or it may be the mandrel which supports the can body. In one such method the neck and flange are formed simultaneously in a can body supported internally and rigidly by a mandrel or chuck of an expanding/collapsing type, the neck and flange profile being formed by external spinning rolls co-operating with this mandrel.

In another method, the can body is supported internally by an anvil and endwise by a spinning pilot, the neck and flange being formed by a profiled, external spinning roll which deforms the can body into a groove formed on the pilot and anvil, the roll being moved axially of the can body.

In all these previously-proposed methods the final profile of the neck and flange is determined by the set profiles of the tool elements used for forming them, in that the tool elements (i.e., spinning rolls, mandrels, anvil etc. are provided rigidly with fix working surfaces shaped to conform with the ultimate shape of the neck and/or the flange, and the metal of the can body is deformed into conformity with these profiles. It is thus necessary, if a different shape is required to change the tools so as to provide differently profiled tool elements.

A method such as that mentioned above, in which an expanding mandrel is used enables end flanges and neck portions to be produced reliably and economically even on can bodies made in the thinner and harder metals currently in favor, in particular double-reduced plate which is usually tinplate, but which may, for example, be aluminum, mild steel or blackplate suitably treated but not necessarily plated with another metal. The present invention is also especially suitable for use with these thinner and harder double reduced or work hardened materials.

The problems with the rolling or spin forming of tooling used in the prior art concerns the weak and relatively unsupported upper sidewall metal of the open end of a D&I can body. Such metal is usually very thin around 0.004" to 0.006", highly worked during ironing and highly grain oriented. Merely placing a tool with the desired profile inside the container and applying a similarly shaped roller to the outside of the container while same is spun does not give the metal during the forming operation adequate or complete support to prevent wrinkling, cracking, buckling, crushing or tearing. This uncontrolled or unsupported application of radial side force on the thin metal sidewall of the open end is unacceptable particularly in connection with the higher temper (H19, T5 or double reduced) materials in connection with operations performed at high speeds wherein the rate of production of the containers during necking and flanging is more than several hundred per minute. No known method for providing adequate support or complete control of the metal during forming was known whereby the problems stated in connection with the forming of necked and flanged containers were overcome.

OBJECTS OF THE DISCLOSURE

It is an object of the disclosure to provide a holding mandrel and roller combination which cooperate to overcome the problems of metal damage during a necking and flanging operation by means of spin flow forming.

It is another object of the invention to disclose a holding mandrel which co-acts with the forming roller to provide continuous support for the metal being spin flow formed into the neck and flange for a thin wall D&I can.

It is still a further object of the invention to disclose a combination of forming roller and holding mandrel which produce a container having a unique, smooth, conical necked in portion extending from the full diameter of the sidewall into the root of the neck and outwardly therefrom to a terminating flange suitable for hermetic double seaming with a small diameter lid.

SUMMARY OF THE DISCLOSURE

Disclosed is a unique tool for flow spin forming the opened end of thin wall D&I cans, a method for using that tool and a unique container configuration easily obtainable at commercial speeds by application of that tool with that method.

DETAILED DESCRIPTION OF THE DISCLOSURE

Figure 1:
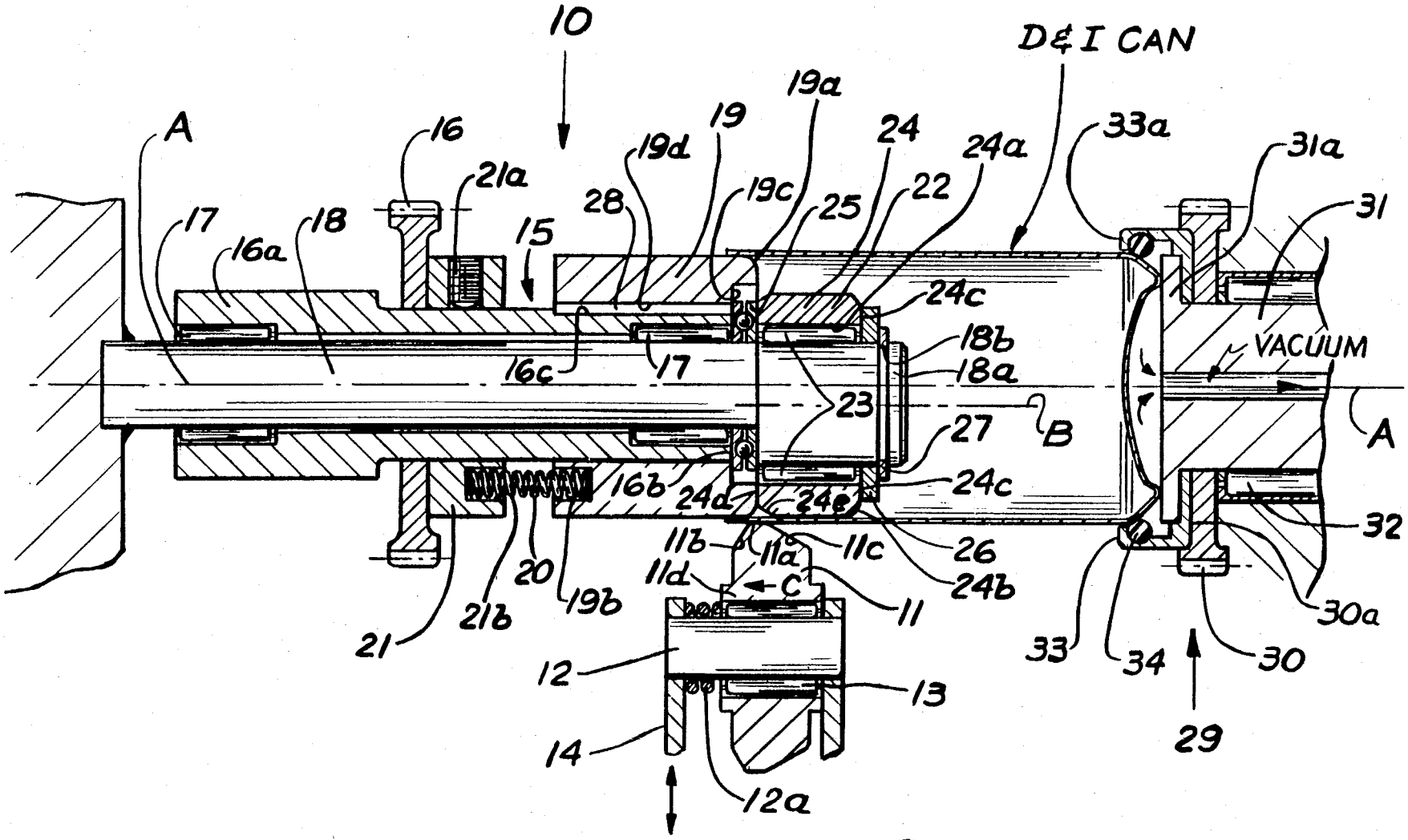
FIG. 1 is a side cross sectional view of a can necking and flanging tool made in accordance with the spirit of the present invention.

An apparatus 10 including a externally positioned roller 11 mounted on a mandrel 12, supported for full rotation by bearing 13 captured between the roller 11 and mandrel 12 to allow roller 11 to freely rotate with respect to its mounting yoke 14. The contour of the nose of periphery of roller 11, as shown in FIG. 1 includes flat 11*a*, a leading portion 11*b* and a trailing port 11*c*. As can be seen in the Figure, the mandrel 12 has a greater axial length than the mounting hub 11*d* for the peripheral roller 11 whereby the roller 11 is free to slide, along the mandrel 12 against the urgings of a coil compression spring 12*a* which sets about mandrel 12 in reaction to axial thrust applied to the roller 11 during spin flow forming. The yoke 14 is mounted for controlled movement toward and away from the axis A of the apparatus 10 such as, for example, by a timed cam means.

The spinning device to drive the D&I can to be necked and flanged by spin flow forming is composed of a can support 15 which includes a gear drive 16 and its extended hub 16*a*, mounting bearings 17 within the extended ends of the hub 16*a*, which ride upon a fixed support shaft 18 and a D&I can end holder 19. The bearings 17 are disposed between shaft 18 and the hub 16*a* of gear 16. Shaft 18 is merely a fixed support and as such is not drivingly rotatable along its axis A. Holder 19 is shaped with a chamfered leading edge portion 19*a* designed to first engage the open end of a trimmed D&I can and then to support same for rotation about axis A in connection with the drive of gear 16 through the hub 16*a* therefore. Holder 19 is also free to slide axially relative to fixed shaft 18 but is resiliently biased into the open D&I can end by springs 20 (only one of which is shown in FIG. 1). The springs 20 are of the compression coil type and are captured in counter bored holes for controlled alignment and positioning. A driving collar 21 is mounted on hub 16*a* and arranged to rotate about shaft 18 in accordance with the drive from gear 16. More particularly, collar 21 has a set screw 21*a* to attach collar 21 to hub 16*a* and hold same adjacent gear 16 so that collar 21 is disposed with its counter bored holes 21*b* set to receive the springs 20 and locate same as to extend to holder 19. For that purpose, there is a cooperating counter bored hole 19*b* therein set to receive the other end of spring 20, shown in FIG. 1, whereby holes 21*b* and 19*b* opposite lead portion 19*a* are opposite each other and aligned to carry spring 20.

Shaft 18 also carries a fixed inner roller assembly 22 which is mounted on an enlarged diameter (relative to the diameter of shaft 18) eccentrically disposed end 18*a* of shaft 18. More particularly, end 18*a* is cylindrical and offset to one side of the axis A such that it has a center line B. The offset is such that it is positioned at the center of the larger diameter of end 18*a* whereby the end 18*a* has one side which is in line with the side of shaft 18 and the other side which is offset relative thereto. Between the sides of end 18*a* and the roller assembly 22 there are bearings 23 which are a part of roller assembly 22 and support same for free rotation about axis B. The roller assembly 22 also includes a roller sleeve 24 having an inner diametrical surface 24*a* supported on bearings 23, an outer contoured surface 24*b* which is adapted to engage a part of the inside wall of the D&I can, a front face 24*c* and a rear face 24*d*. The latter is adapted to abut the portion 19*a* and more specifically, the face thereof when same is urged outwardly of collar 21.

Roller assembly 22 is restrained from axial movement relative to shaft end 18*a* by an inner axial bearing 25 disposed between the roller sleeve 24, rear face 24*d* and the holder 19. More particularly, holder 19 includes a recessed inner bore 19*c* which provides space for receiving the axial thrust bearing 25 and thereby limits the motion of holder 19 axially outwardly in response to the urgings of springs 20 whereby in its outwardmost position (holder 19 to the right in FIG. 1) abuts at 19*a* near face 24*d* of the sleeve but really against thrust bearing 25.

The outer end of sleeve 24 is maintained by means of a thrust bushing 26 in a form of a washer which during assembly is slid over end 18*a* and is held axially thereon by a retaining ring 27 disposed within a groove 18*b* circumscribed about the distal periphery of end 18*a*. Consequently, sleeve 24 is held in position between the bushing 26 and the bearing 25 so its axial location, relative to end 18*a* is fixed. Bearing 25 acts as a stop for the outward axial motion of holder 19 but the location of bearing 25 is defined by the hub 16*a* upon which gear 16 is carried. More specifically, the hub has bearings 17, as already mentioned, which ride on fixed shaft 18 and hub 16*a* extends to the right through attached collar 21 to its end 16*b* which abuts bearing 25 and carries bearing 17 inside that end. In a manner well known, hub 16*a* is free to rotate relative to shaft 18 but because of a keyed relationship between hub 16*a* and in particular a keyway 16*c* on hub 16*a* and 19*d* on holder 19 axial movement between holder 19 and hub 16*a* is permitted even though holder 19 rotates with hub 16*a*. In the keyway, defined by 16*c* and 19*d* is a key 28 which acts like a spline to permit the axial motion of the holder 19 outwardly in response to the urgings of springs 20.

The D&I can is supported by its bottom which includes vacuum. This, of course, is not the only way in which the container may be held during its rotation along the axis A but FIG. 1 illustrates a convenient means by which the bottom of a container may be supported along a specific axis as it is rotated. More particularly, there is a chuck assembly 29 which includes a gear 30 driven at the same speed and in a manner similar to that used to drive gear 16. For example, by a jack shaft with pinions (not shown). Gear 30 has a center hub 31 which is provided with an axially positioned vacuum passage to permit vacuum to pass therethrough for purposes of holding the bottom of the D&I can. Hub 31 is supported cantilever on a bearing 32 whereby gear 30 can rotate when driven about axis A. A cup 33 is mounted to the face 30A of gear 30 and extends outwardly therefrom along axis A toward the bottom of the D&I can. Cup 33 is designed to carry an O-ring 34 within the inwardly (radial) rolled end thereof 33*a* in order to define a place against which the D&I can bottom can be sealed in order to maintain the vacuum established through the hub 31. More particularly, hub 31 has an extending flange 31*a* against which the bottom of the D&I can rests whereby the lower side wall is sealingly engaged with the O-ring 34.

In operation the yoke 14 carries peripheral roller 11 to engage the side wall of the open trimmed end of the D&I can between where same is supported by holder 19 and sleeve 24 while the D&I can is rotated between the hub 31 and the holder 19. The peripheral roller 11 is moved radially inward in response to controlled motion of yoke 14 and begins to define a conical necked-in end on the D&I can. More specifically, trailing portion 11*c* of roller 11 bears against the sidewall of the open end of the D&I can camming the roller 11 axially to the left in accordance with arrow C. For this purpose the end on sleeve 24 is chamfered at corner 24*e* and same cooperates with the trailing part 11*c* to define the angle of the conical neck for the D&I can. Any reasonable obtuse (with respect to the inside wall) angle is obtainable. The spin flow forming of the D&I can due to inward motion (radially) of roller 11 would be uncontrolled except for the fact that holder 19 is spring loaded axially outward (to the right) to engage the radially inwardly moving end of axially slidable roller 11. More specifically, the lead portion 11*b* of roller 11 comes into contact with portion 19*a* on holder 19 so that same will be urged under the spring force of coil springs 20 against the chamfer 24*e*.

It can now be appreciated that the force required to neck the end of the D&I can, can be maintained against the conically forming end by means of the cooperation between trailing part 11*c* and chamfer 24*e* both of which define the angle of the cone to be formed. The resistance to movement in the direction of arrow C of roller 11 by the contact between leading portion 11*b* and the portion 19*a* of holder 19 is essential. Throughout the forming of the conical end the motion radially inward of the yoke 14 which carries the roller 11 is similarly controlled. The axial motion in the direction of arrow C of the roller and the forming of the conical end between the roller 11 and the sleeve 24 are entirely controlled without any release of force against the container end during the spin flow forming.

The offset between axis A and axis B is provided in order to permit removal of the necked container notwithstanding the larger diameter of assembly 22. More particularly, the diameter to which the container is necked is still greater than the diameter of the assembly 22 whereby release of the conically necked D&I can from the chuck assembly 29 permits the container to tip relative to its axis A and slide over the offset of eccentric assembly 22.

While a particular arrangement has been shown and described, skilled artisans will appreciate that the design of the drive mechanism, the chuck or even the offset eccentric roller assembly can be modified and still be within the scope of the claims which follow. More particularly, the invention herein is the control of the metal forming tools not their particular configuration or structural arrangement

What we claim is:

1. An apparatus for holding and rotating a thin wall hollow cylindrical container about its axis whereby same is supported with a straight wall open end for receiving a spin flow forming tool to neck and flange that end comprising:

a holder for engaging the inside of the straight wall open end of the container being mounted for driven rotary motion about and axial motion along the axis of the container and having a resilient means located thereon to bias said holder along that axis and into the open end of the container, a roller with a peripheral deforming nose positioned externally of the container and mounted upon a mandrel for free rotary and controlled radial movement toward and away from the sidewall of the container, said roller being biased for axial movement along its mandrel and said roller mandrel being located parallel to the axis of the container but external thereof, a sleeve member within the container and supported on another axis positioned parallel to the axis of the container but offset therefrom a predetermined distance and said sleeve member supported for free rotary motion in a predefined fixed axial position inwardly of the container relative to said holder for engagement with the inside wall of the container open end and abutment with the inward face of said holder to define a plane therebetween near which the nose of said roller first contacts the straight wall open end for spin flow forming the contacted wall inwardly when said roller is moved toward said container axis against the straight wall and between said holder and said sleeve member, said sleeve member having a flat circumferential chamfer at its end opposed to the inward face of said holder and said roller having a peripheral flat surface and also having a sloped trailing surface opposed to said chamfer, said container having a portion of its open end supported by said holder so that said open end portion extends across said plane, and said roller being positioned opposite the portion of the container which extends across said plane, whereby during radial inward movement of the roller into said plane the biased holder forces the biased roller toward the axially fixed sleeve while the chamfer on the axially fixed sleeve cooperates with the opposed sloped surface of the roller to shape a cone on the can as the roller continues its radial inward movement as part of the necking operation performed on the can.

2. The apparatus of claim 1 wherein said holder has a leading portion chamferred inwardly relative to its axis.

3. The apparatus of claim 2 wherein said holder has means for supporting compression coil springs and for holding same in parallel spaced relation to the axis thereof in order to urge said holder inwardly and against the straight wall as same is necked under the spin flow forming of said roller.

4. The apparatus of claim 3 wherein the container is supported at its open end by said holder and at its opposite end by a chuck.

* * * * *